US007303413B1

(12) United States Patent
Lai et al.

(10) Patent No.: US 7,303,413 B1
(45) Date of Patent: Dec. 4, 2007

(54) DRAWER-TYPE CARD CONNECTOR

(75) Inventors: Yaw-Huey Lai, Taipei County (TW); Chin-Hwa Wu, Taoyuan County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/703,197

(22) Filed: Feb. 7, 2007

(30) Foreign Application Priority Data

Nov. 7, 2006 (TW) ..... 95219651 U

(51) Int. Cl.
*H01R 13/62* (2006.01)

(52) U.S. Cl. ..... 439/152; 439/347; 439/630; 439/923

(58) Field of Classification Search ..... 439/152–155, 439/157–160, 347, 630, 923
See application file for complete search history.

(56) References Cited

U.S. PATENT DOCUMENTS 6,957,969 B2 * 10/2005 Kodera et al. ..... 439/152
7,097,475 B2 * 8/2006 Cheng ..... 439/138
7,198,497 B1 * 4/2007 Lai et al. ..... 439/159
7,229,300 B2 * 6/2007 Lai et al. ..... 439/159
2005/0037648 A1 * 2/2005 Kodera et al. ..... 439/152
2007/0105446 A1 * 5/2007 Lai et al. ..... 439/630

* cited by examiner

*Primary Examiner*—James Harvey
(74) *Attorney, Agent, or Firm*—Bacon & Thomas, PLLC

(57) ABSTRACT

A drawer-type card connector is composed of a base, a cover member, a slide member, a card-fastening device. The base includes a bottom plate. The slide member is slidably mounted in the base, including a top plate, a left sidewall, and a right sidewall. A receiving chamber for receiving the inserted card is formed among the bottom plate, the top plate, the left sidewall, and the right sidewall. The card-fastening device includes two pivot members pivotably connected with the slide member, a prop mounted between the two pivot members and parallel to the bottom plate for pivoting downward, and at least one stop portion extending from the prop. When the card is inserted fully, the prop supports the card, the at least one stop portion stops against the card, and the bottom plate supports the prop, thus effectively preventing the card from disengagement from the card connector.

7 Claims, 12 Drawing Sheets

DRAWER-TYPE CARD CONNECTOR

BACKGROUND OF THE INVENTION

1. Field of the Invention

The present invention relates generally to electronic card connectors, and more particularly, to a drawer-type card connector capable of firmly holding an inserted electronic card and preventing the card from disengagement therefrom.

2. Description of the Related Art

The currently available drawer-type card connector includes a base and a drawer-type slide member. An electronic card can be entirely placed in the slide member and moved into and out of the base together with the slide member. Because the rear end edge of the card does not particularly have means for firmly buckling itself, such card connector fails to firmly hold the card and the card is subject to disengagement from the card connector.

SUMMARY OF THE INVENTION

The primary objective of the present invention is to provide a drawer-type card connector which can firmly hold an inserted card and further prevent the card from disengagement therefrom and from falling onto the ground.

The foregoing objective of the present invention is attained by the drawer-type card connector composed of a base, a slide member, a card-fastening device, a cover member, an ejecting device, and a plurality of contact terminals. The base includes a bottom plate. The slide member is slidably mounted in the base, including a top plate, a left sidewall, a right sidewall, and a rear sidewall, the latter three of which extend downward from the top plate. A receiving chamber is formed among the bottom plate of the base and the top plate, the left sidewall, and the right sidewall of the slide member, for receiving the inserted card. The card-fastening device includes two pivot members rotatably mounted to respective left and right sides of a front end of the slide member, a prop mounted between the two pivot members and parallel to the bottom plate for pivoting downward by a force, and at least one stop portion extending from the prop. When the card is fully inserted into the card connector, the prop supports a lower surface of the card, the at least one stop portion stops against a rear end edge of the card, and the bottom plate supports the prop. In light of this, the prop fails to move downward to keep the stop portion stopping against the rear end edge of the card, thus effectively preventing the card from disengagement from the card connector.

DETAILED DESCRIPTION OF PREFERRED EMBODIMENTS

Figure 1:
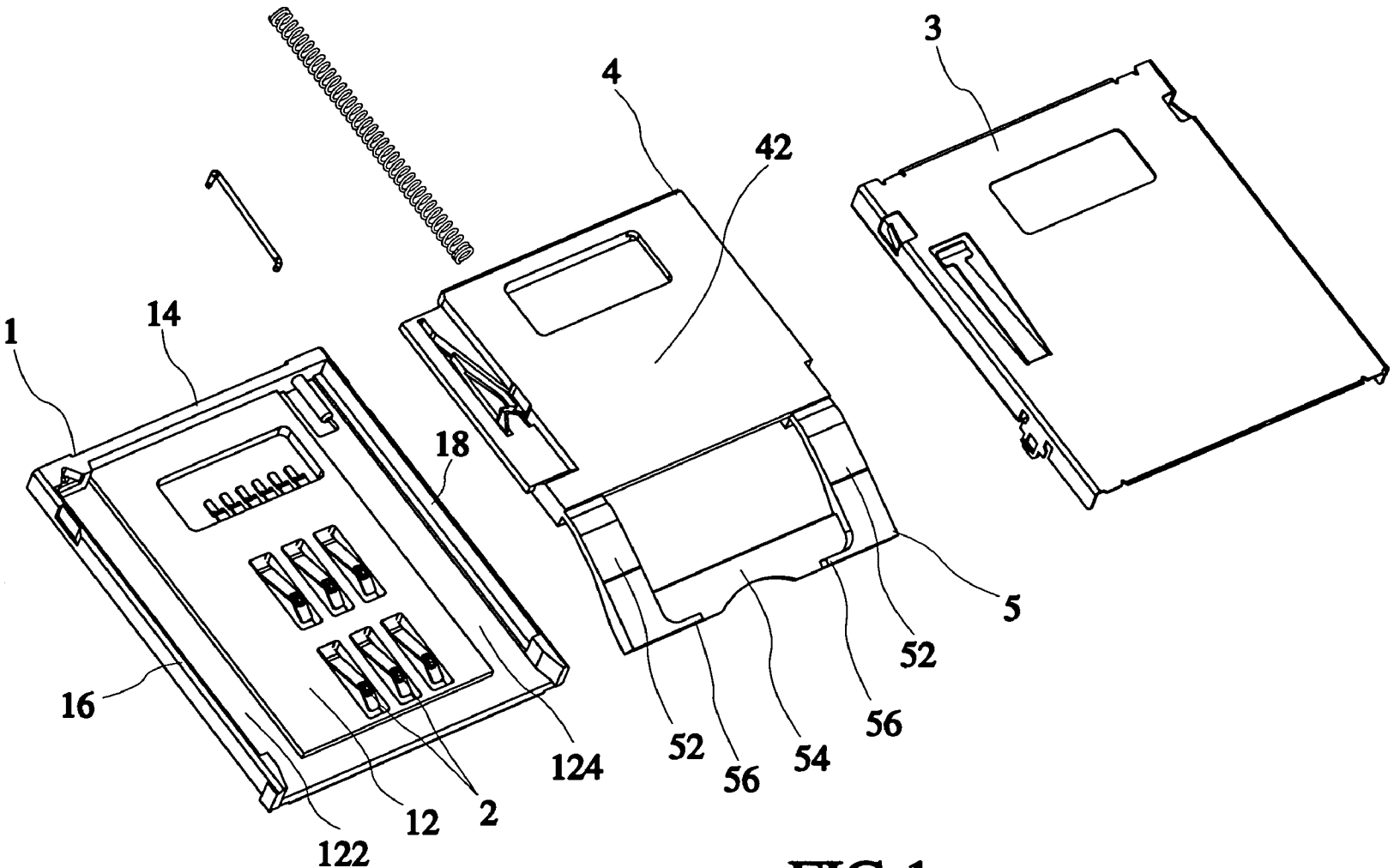
FIG. 1 is an exploded view of a first preferred embodiment of the present invention.
Figure 2:
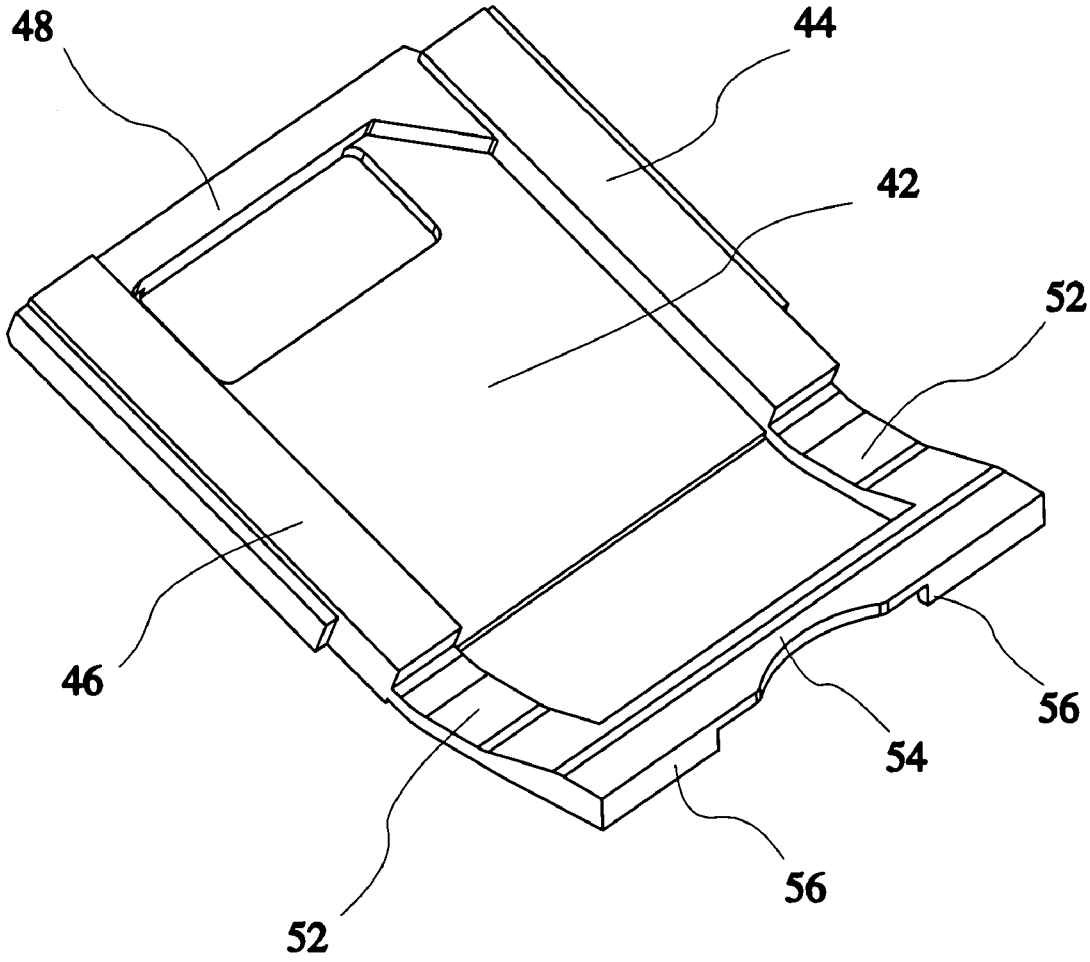
FIG. 2 is a perspective view of the slide member according to the first preferred embodiment of the present invention.
Figure 3:
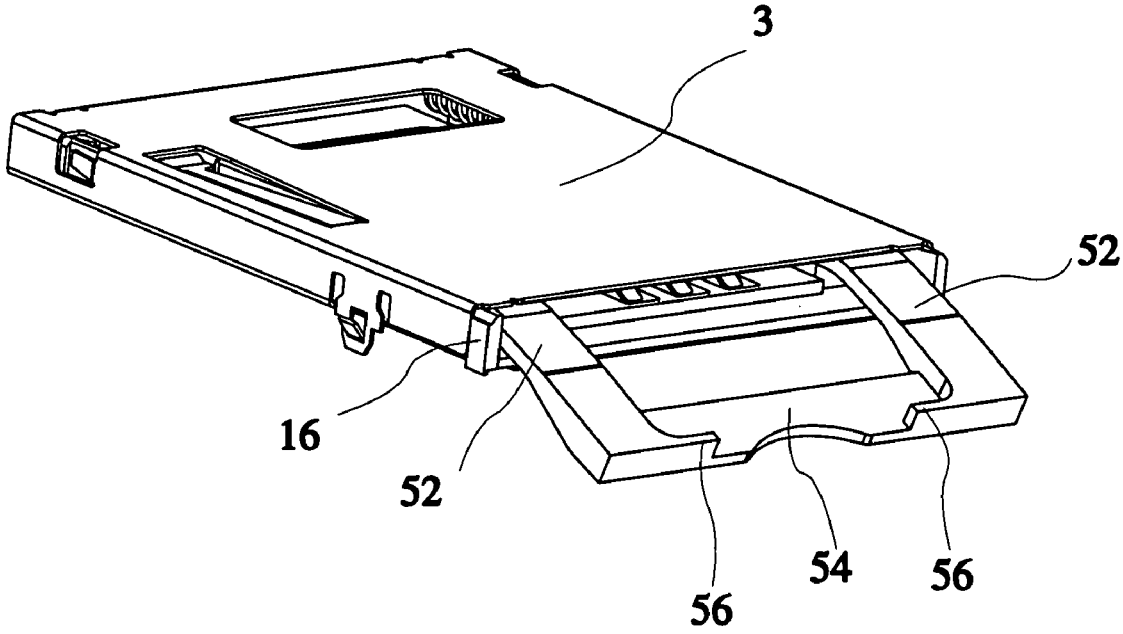
FIG. 3 is a perspective view of the first preferred embodiment of the present invention.
Figure 5:
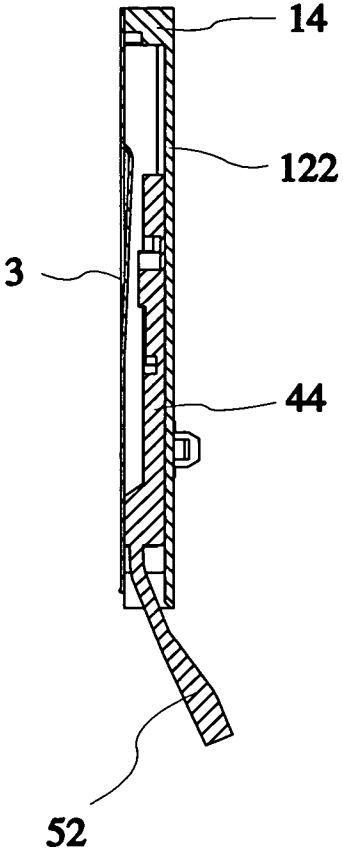
FIG. 5 is a sectional view taken along a line 5-5 indicated in FIG. 4.
Figure 4:
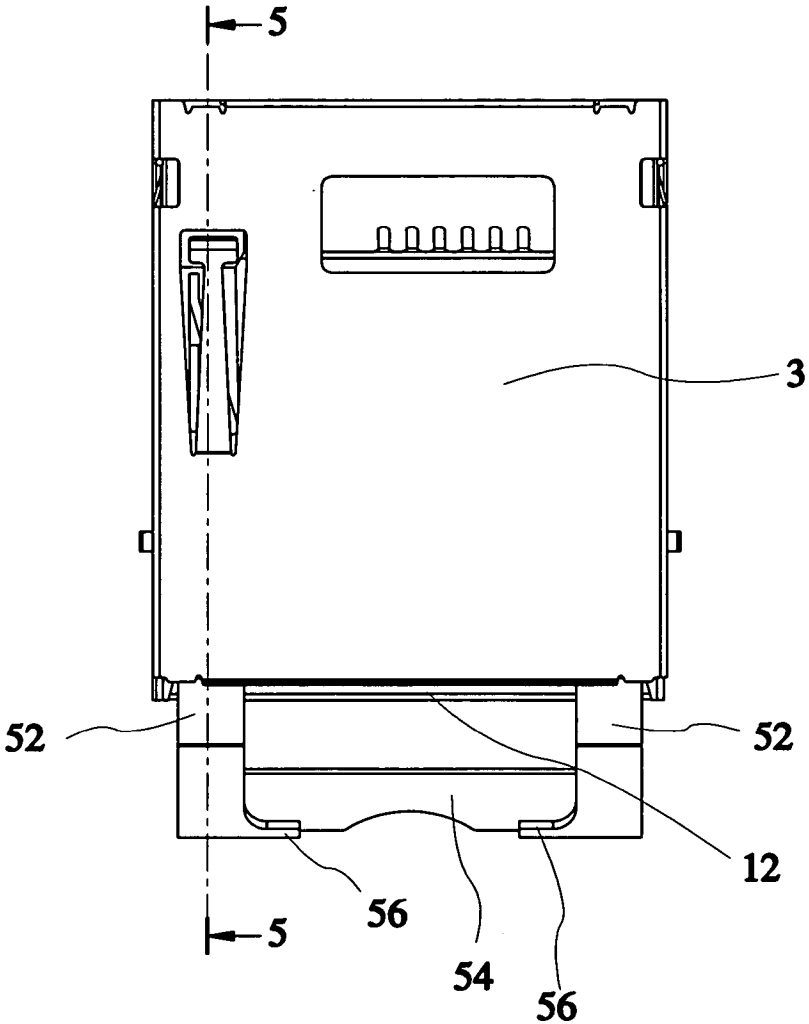
FIG. 4 is a top view of the first preferred embodiment of the present invention, showing that the card has not been inserted yet.
Figure 7:
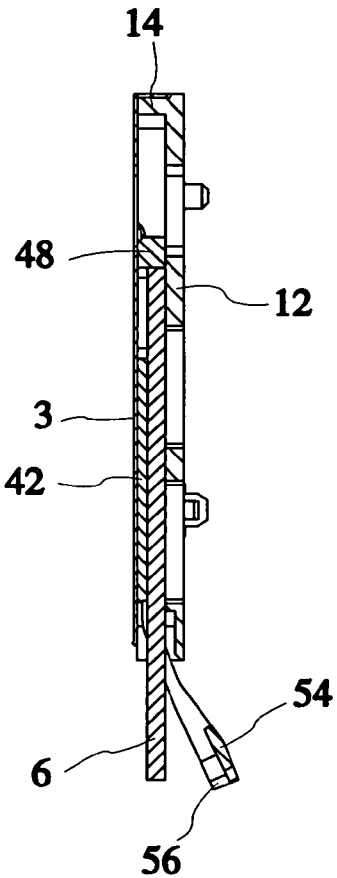
FIG. 7 is a sectional view taken along a line 7-7 indicated in FIG. 6.
Figure 6:
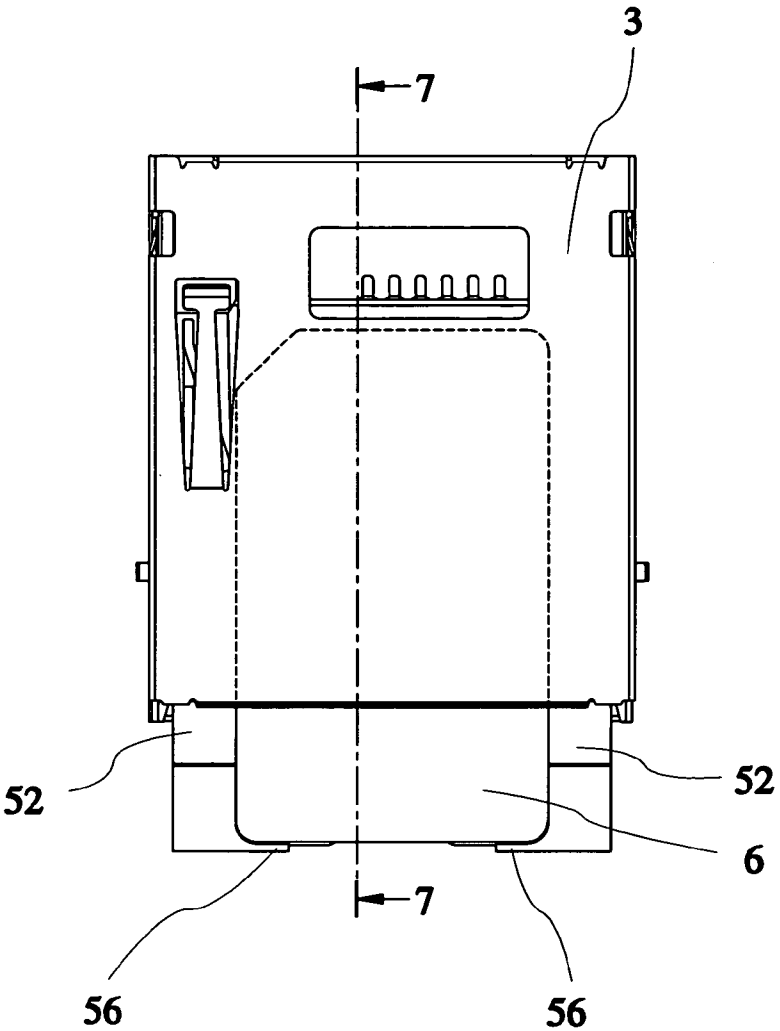
FIG. 6 is another top view of the first preferred embodiment of the present invention, showing the card is being inserted.
Figure 9:
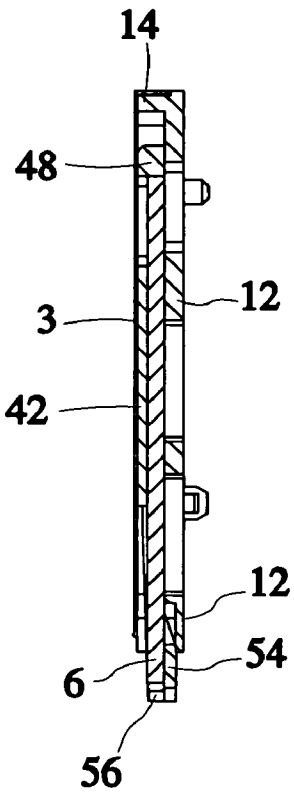
FIG. 9 is a sectional view taken along a line 9-9 indicated in FIG. 8.
Figure 8:
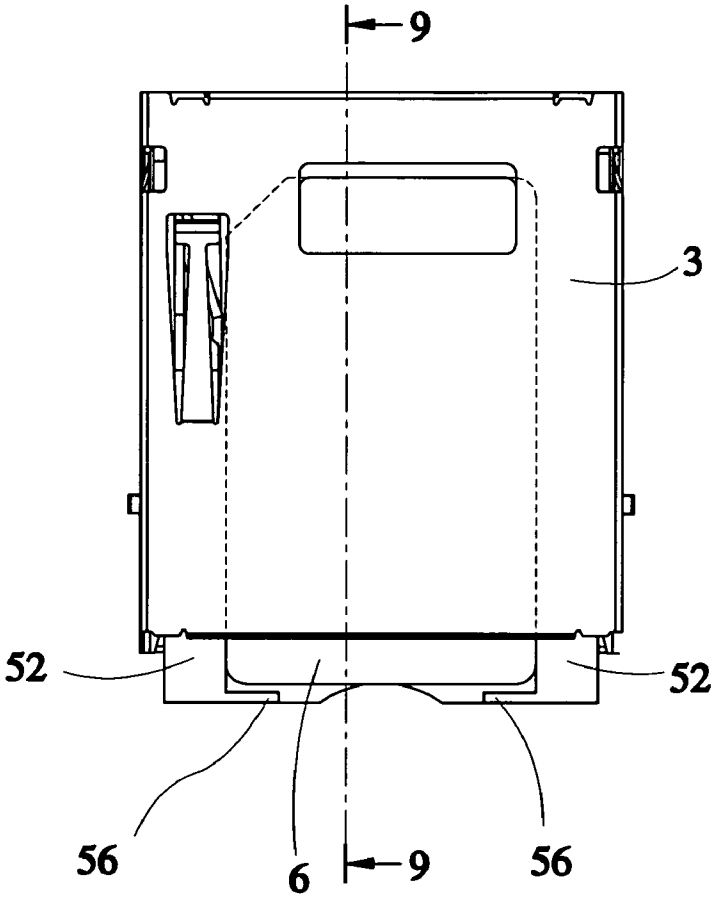
FIG. 8 is another top view of the first preferred embodiment of the present invention, showing the card-fastening device is turned to a horizontal position.
Figure 11:
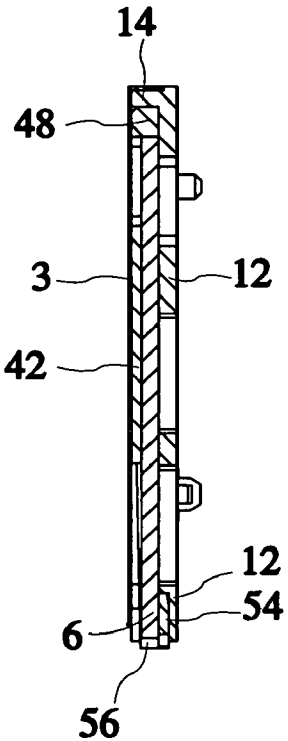
FIG. 11 is a sectional view taken along a line 11-11 indicated in FIG. 10.
Figure 10:
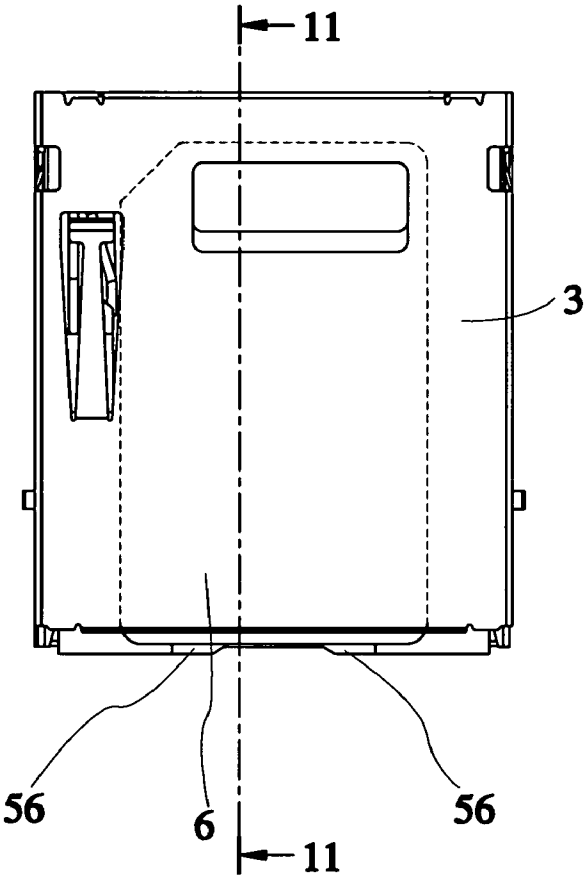
FIG. 10 is another top view of the first preferred embodiment of the present invention, showing the card is fully inserted.

Referring to FIGS. 1-11, a drawer-type card connector constructed according to a first preferred embodiment of the present invention is composed of a base 1, a plurality of contact terminals 2, a cover member 3, a slide member 4, a card-fastening device 5, and an ejecting device for receiving an electronic card 6 inserted therein.

The base 1 includes a bottom plate 12, a rear sidewall 14 extending vertically upward from a rear end of the bottom plate 12, a left sidewall 16 extending vertically upward from a left end of the bottom plate 12, and a right sidewall 18 extending vertically upward from a right end of the bottom plate 12. The bottom plate 12 has a left slide way 122 located close to the left sidewall 16 and extending along a direction that the card 6 is inserted into the card connector, and a right slide way 124 located close to the right sidewall 18 and extending along the same direction.

The contact terminals 2 are mounted to a midsection of the bottom plate 12.

The cover member 3 is buckled onto the base 1.

The slide member 4 is slidably mounted in the base 1, including a top plate 42, a left sidewall 44 extending vertically downward from a left end of the top plate 42, a right sidewall 46 extending vertically downward from a right end of the top plate 42, and a rear sidewall 48 extending vertically downward from a rear end of the top plate 42. A receiving chamber for receiving the card 6 is formed among the bottom plate 12 of the base 1 and the top plate 42, the left sidewall 44, and the right sidewall 46 of the slide member 4.

When the slide member 4 is slidably moved in the base 1, the left sidewall 44 is slidably moved in the left slide way 122 along the direction that the card 6 is inserted. The right sidewall 46 is slidably moved in the right slide way 124 along the same direction.

The card-fastener device 5 includes two bendable pivot members 52 extending forward from the left and right sidewalls 44 and 46 respectively, a prop 54 formed between the two pivot members 52, and two stop portions 56 extending along a front edge of the prop 54 from two respective front ends of the two pivot members 52. The card-fastening device 5 can be located at two stable positions as follows. When the card-fastening device 5 is located at a first position, the two pivot members 52 are bended downward for a given angle and then positioned slantwise; meanwhile, the card 6 can be inserted through what is between the prop 54 and the two pivot members 52 into what is between the top plate 42 and the bottom plate 12. When the card-fastening device 5 is located at a second position, the two pivot members 52 are bended upward to enable the prop 54 to be parallel to the bottom plate 12; meanwhile, an upper surface of the prop 54 is located as high as that of the bottom plate 12. When the card 6 is inserted into the card connector, the prop 54 supports a lower surface of the card 6 and the two stop portions 56 stop against a rear end edge of the card 6, thus preventing the card 6 from disengagement from the card connector.

The ejecting device includes a guide bar, a spring, and a heart-shaped groove formed in the slide member 4, for facilitating successful sliding movement of the slide member 4 and ejection of the card 6. Because the ejecting device belongs to the prior art, no detailed description is necessary.

When a user intends to insert the card 6 into the card connector, the user can bend the card-fastening device 5 downward to the first position and then insert the card 6 into the receiving chamber through what is between the prop 54 and the two pivot members 52. When the front end of the card 6 contacts against the rear sidewall 48 of the slide member 4 and then continues to be pushed further to drive the slide member 4 to move toward the rear sidewall 14 of the base 1; meanwhile, the prop 54 is pushed by the bottom plate 12 to move toward the card 6. When the card 6 is fully inserted, contact pins (not shown) of the card 6 right contact the contact terminals 2 for electric conduction, the prop 54 supports the lower surface of the card 6, and the two stop portions 56 stop against the rear end edge of the card 6, effectively preventing the card 6 from disengagement from the card connector and then falling onto the ground.

Figure 12:
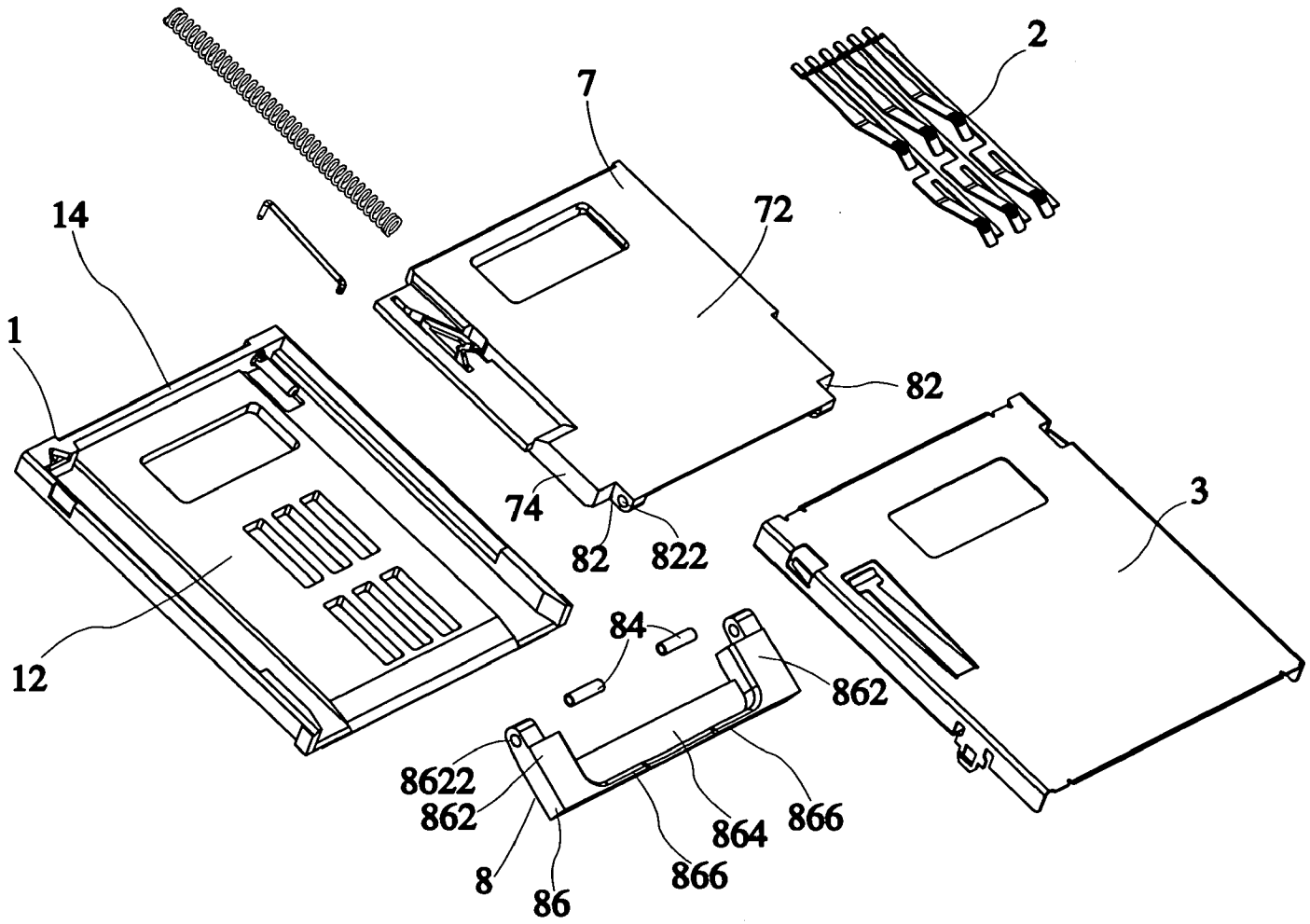
FIG. 12 is an exploded view of a second preferred embodiment of the present invention.
Figure 13:
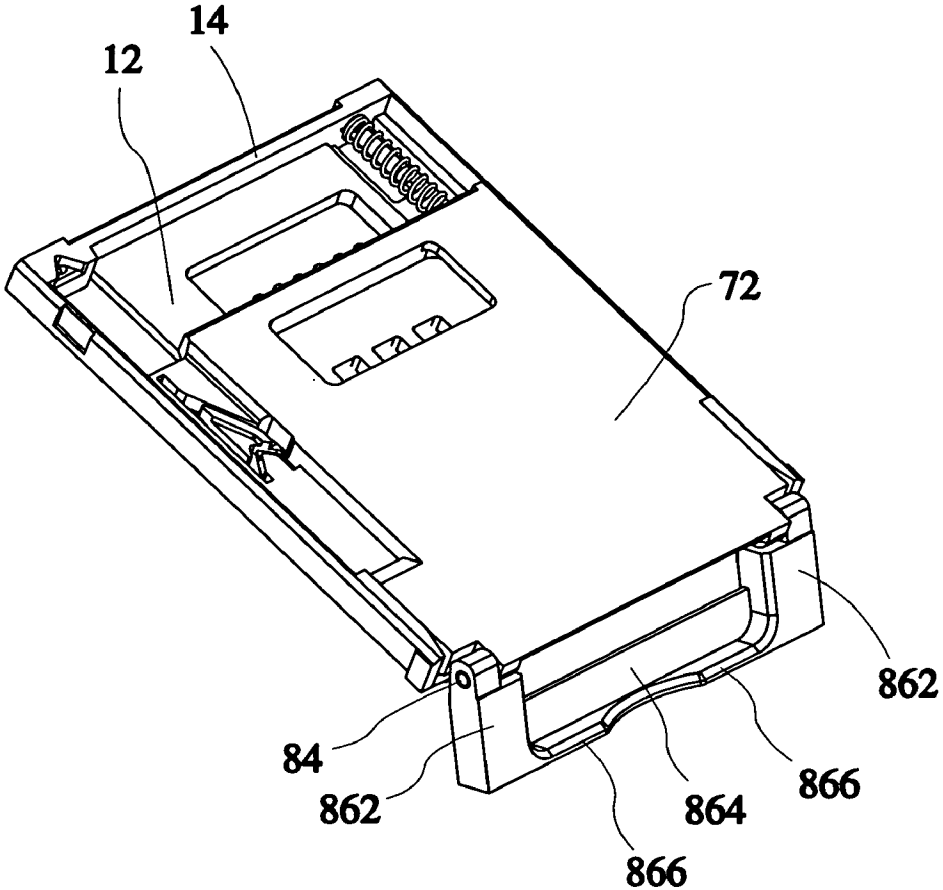
FIG. 13 is a perspective view of the second preferred embodiment of the present invention.
Figure 14:
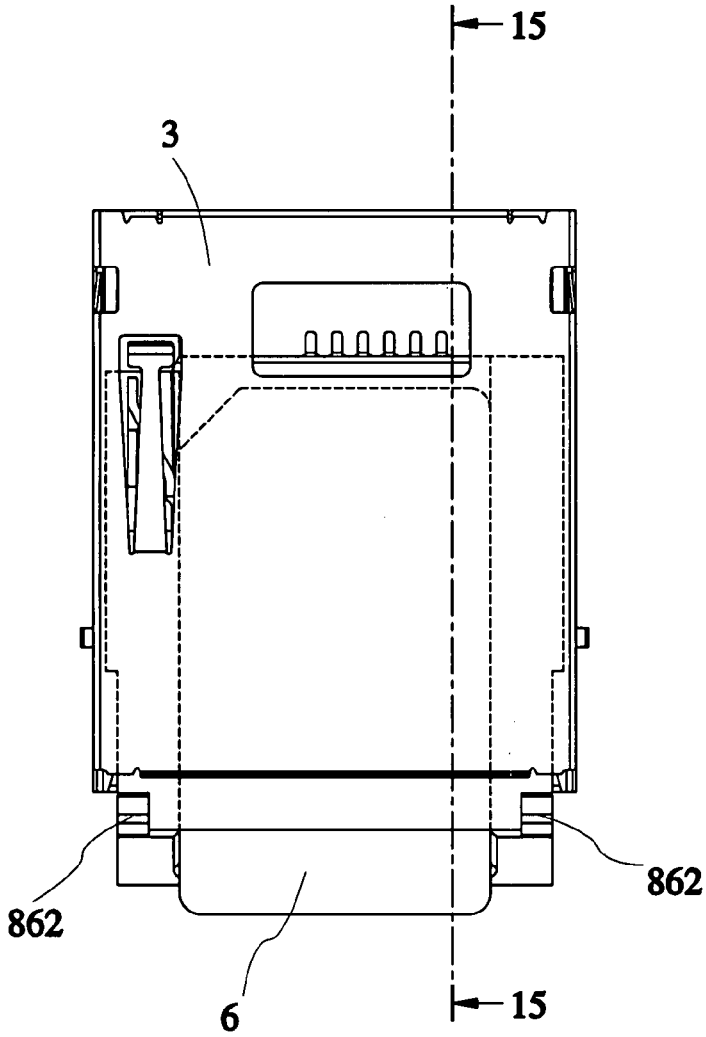
FIG. 14 is a top view of the second preferred embodiment of the present invention, showing the card is being inserted.
Figure 15:
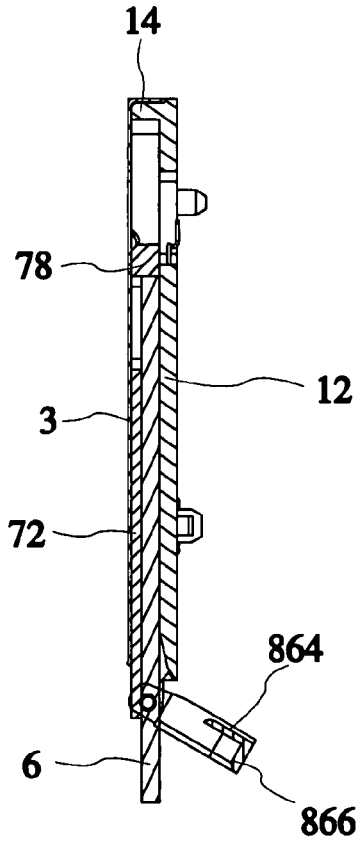
FIG. 15 is a sectional view taken along a line 15-15 indicated in FIG. 14
Figure 16:
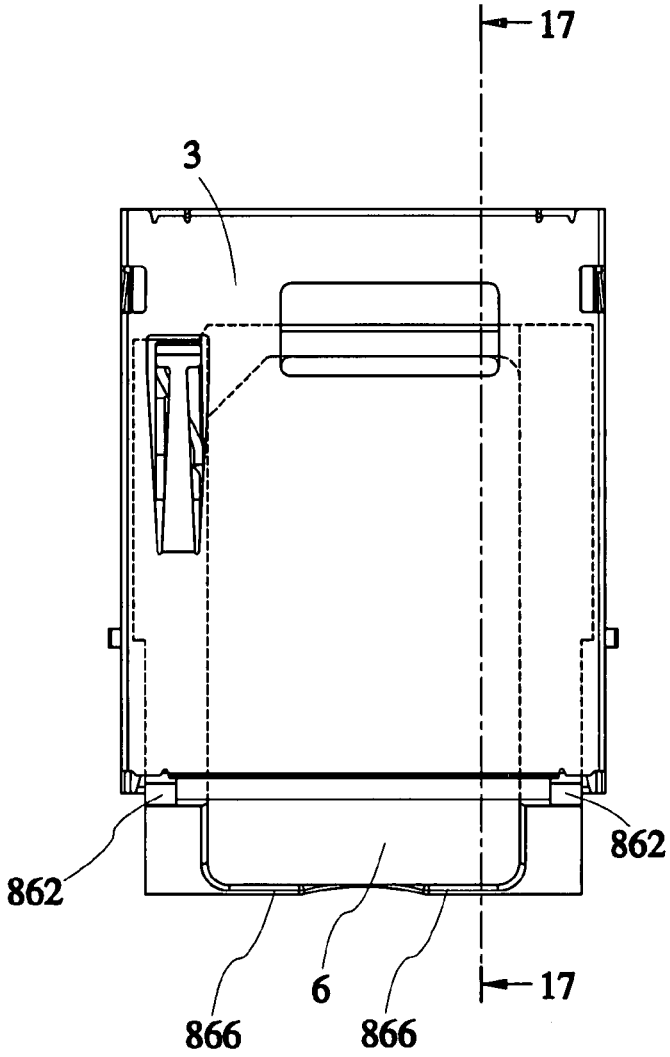
FIG. 16 is another top view of the second preferred embodiment of the present invention, showing that the card is inserted further.
Figure 17:
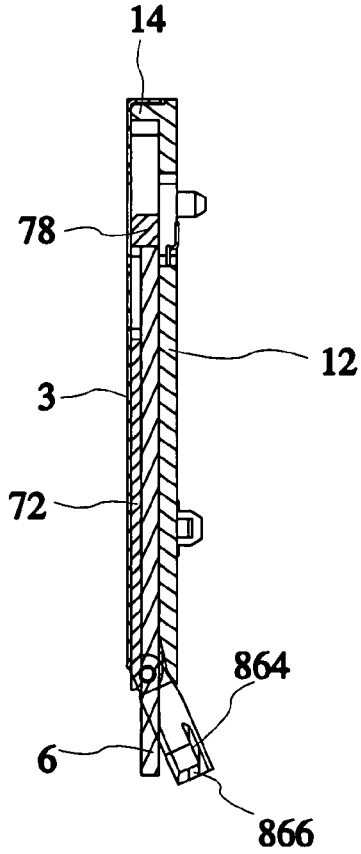
FIG. 17 is a sectional view taken along a line 17-17 indicated in FIG. 16.
Figure 20:
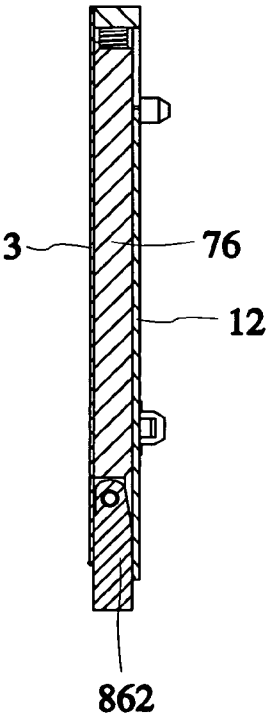
FIG. 20 is a sectional view taken along a line 20-20 indicated in FIG. 18, showing the position of the pivot members after the card is fully inserted.
Figure 19:
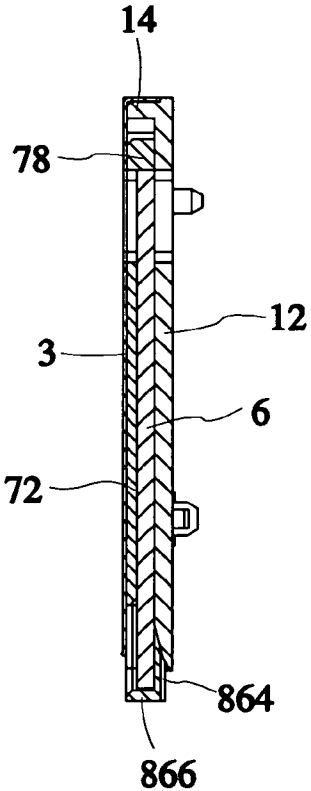
FIG. 19 is a sectional view taken along a line 19-19 indicated in FIG. 18.
Figure 18:
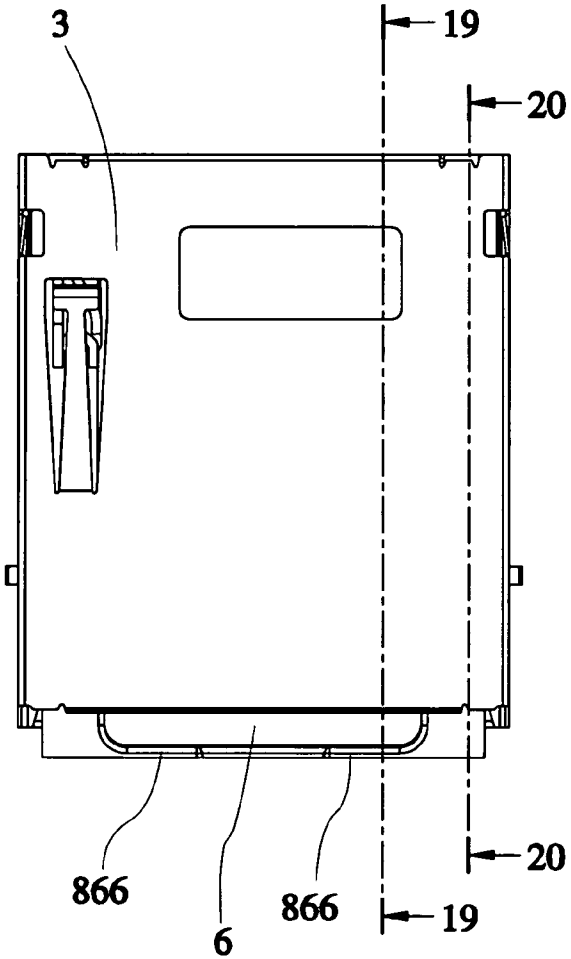
FIG. 18 is another top view of the second preferred embodiment of the present invention, showing that the card is fully inserted.

Referring to FIGS. 12-20, a drawer-type card connector constructed according to a second preferred embodiment of the present invention is similar to that of the first embodiment, composed of the same base 1, the same contact terminals 2, the same cover member 3, the same ejecting device, a slide member 7, and a card-fastening device 8, for receiving the card 6.

The contact terminals 2 are mounted to the midsection of the base plate 12.

The cover member 3 is buckled onto the base 1.

The slide member 7 includes a top plate 72, a left sidewall 74 extending vertically downward from a left end of the top plate 72, a right sidewall 76 extending vertically downward from a right end of the top plate 72, and a rear sidewall 78 extending vertically downward from a rear end of the top plate 72.

The card-fastening device 8 includes two pivot portions 82 formed at respective front ends of the left and right sidewalls 74 and 76 of the slide member 7, two pins 84, and a hingeable fastener 86 hingedly mounted to a front end of the slide member 7. The two pivot portions 82 each have a pivot hole 822 therein. The hingeable fastener 86 has two pivot members 862 pivotably connected with respective left and right sides of the front end of the slide member 7, a prop 864 located between the two pivot members 862, and two stop portions 866 extending along a front end edge of the prop 864 from respective front ends of the two pivot members 862. The pivot members 862 have two pivot orifices 8622 formed at respective rear ends thereof and corresponding to the respective pivot holes 822. The two pins 84 are mounted to the pivot holes 822 and the pivot orifices 8622 respectively to enable the hingeable fasteners 86 to be hingedly mounted to the front end of the slide member 7.

The card-fastening device 8 can be likewise located at two stable positions as follows. When the card-fastening device 8 is located at a first position, the two hingeable fasteners 86 are turned downward for a given angle and then positioned slantwise; meanwhile, the card 6 can be inserted through what is between the prop 864 and the two pivot members 862 into what is between the top plate 72 and the bottom plate 12. When the card-fastening device 8 is located at a second position, the hingeable fasteners 86 are turned upward to enable the prop 864 to be parallel to the bottom plate 12; meanwhile, the upper surface of the prop 864 is located as high as that of the bottom plate 12. When the card 6 is inserted into the card connector, the prop 864 supports the lower surface of the card 6 and the two stop portions 866 stop against a rear end edge of the card 6, thus preventing the card 6 from disengagement from the card connector.

The ejecting device includes a guide bar, a spring, and a heart-shaped groove formed on the slide member 7, for facilitating successful sliding movement of the slide member 7 and ejection of the card 6. Because the ejecting device belongs to the prior art, no detailed description is necessary.

During the insertion of the card 6 into the card connector, the hingeable fastener 86 is turned downward to the first position and the card 6 is inserted into what is between the prop 864 and the two pivot members 862. When the front end of the card 6 contacts against the rear sidewall 78 of the slide member 7 and the card 6 continues to be pushed to drive the slide member 7 to move toward the rear sidewall 14 of the base 1, the prop 864 of the card-fastening device 8 is forced by the bottom plate 12 of the base 1 to move toward the card 6. When the card 6 is fully inserted into the card connector, the contact pins (not shown) of the card 6 right contact the contact terminals 2 for electric conduction and the prop 864 supports the lower surface of the card 6 and the two stop portions 866 stop against the rear end edge of the card 6. Because the bottom plate 12 supports the prop 864, the prop fails to move downward to enable the stop portions 866 to keep stopping against the rear end edge of the card 6, thus effectively preventing the card 6 from disengagement from the card connector and from falling onto the ground.

Although the present invention has been described with respect to the specific preferred embodiments thereof, it is no way limited to the details of the illustrated structures but changes and modifications may be made within the scope of the appended claims.

What is claimed is:

1. A drawer-type card connector comprising:

a base having a bottom plate;

a cover member;

an ejecting device;

a slide member slidably mounted in said base and having a top plate, a left sidewall, a right sidewall, and a rear sidewall, said left, right, and rear sidewalls extending downward from said top plate;

a plurality of contact terminals; and a card-fastening device having two pivot members pivotably connected with respective left and right sides of a front end of said slide member, a prop mounted between said two pivot members and parallel to said bottom plate of said base for pivoting downward by a force, and at least one stop portion extending from said prop;

wherein a receiving chamber for receiving an electronic card is formed among said bottom plate of said base and said top plate, said left sidewall, and said right sidewall of said slide member;

whereby when the card is fully inserted into said card connector, said prop supports a lower surface of the card, said at least one stop portion stops against a rear end edge of the card, and said bottom plate supports said prop.

2. The card connector as defined in claim 1, wherein said two pivot members extend forward from respective front ends of said left and right sidewalls of said slide member.

3. The card connector as defined in claim 1, wherein said card-fastening device comprises two stop portions extending from a front end edge of said prop.

4. The card connector as defined in claim 1, wherein said card-fastening device comprises a hingeable fastener hingedly mounted to the front end of said slide member, said hingeable fastening having said pivot members, said prop, and said at least one stop portion.

5. The card connector as defined in claim 4, wherein said card-fastening device further comprises two pivot portions formed at respective front ends of said left and right sidewalls of said slide member, two pins, two pivot holes formed in said two pivot portions respectively, and two pivot orifices formed at respective rear ends of said two pivot members and corresponding to said two pivot holes, said two pins being mounted to said pivot holes and orifices respectively, whereby said hingeable fastener is hingedly mounted to the front end of said slide member.

6. The card connector as defined in claim 1 or 2 or 4 or 5, characterized in that the card is inserted through what is between said prop and said two pivot members turning downward for a predetermined angle into what is between said top plate of said slide member and said bottom plate of said base.

7. The card connector as defined in claim 1 or 2 or 4 or 5, characterized in that an upper surface of said prop is located as high as that of said bottom plate of said base when the card is fully inserted into said card connector.

* * * * *